US005417027A

United States Patent [19]

Wagenet

[11] Patent Number: 5,417,027

[45] Date of Patent: May 23, 1995

[54] LINKING FRAMES CONSTRUCTIONS

[76] Inventor: John Wagenet, 1462 Casteel Dr., Willits, Calif. 95490

[21] Appl. No.: 114,901

[22] Filed: Sep. 2, 1993

[51] Int. Cl.[6] ..... F04B 1/32; F16S 3/04

[52] U.S. Cl. ..... 52/653.1; 52/86; 52/641; 52/645; 446/125; 482/35

[58] Field of Search ..... 52/86, 639, 641, 645, 52/653.1, 656.1; 446/124, 125; 482/23, 35, 36

[56] References Cited

U.S. PATENT DOCUMENTS

| | | | |
|---|---|---|---|
| 3,260,022 | 7/1966 | Guyer et al. | 52/86 |
| 4,190,990 | 3/1980 | McAllister | 52/86 X |
| 4,887,397 | 12/1989 | Peterson | 52/108 X |
| 5,363,627 | 11/1994 | Wilson | 52/86 X |

FOREIGN PATENT DOCUMENTS

| | | | |
|---|---|---|---|
| 38542 | 3/1928 | Denmark | 482/23 |

*Primary Examiner*—Carl D. Friedman
*Assistant Examiner*—Kevin D. Wilkens
*Attorney, Agent, or Firm*—Harris Zimmerman

[57] ABSTRACT

Structural frameworks of differing shapes and for diverse purposes may be assembled by linking essentially rectangular, open centered frames together in end to end relationship by extending side members of individual ones of the frames into the open centers of adjacent ones of the frames. Sidewardly extending projections on individual frames overlap and abut side members of the adjacent frames to hold the members in a linked condition and to impart load bearing capability to the framework. Frameworks of differing geometry can be assembled from the same set of frames. The linked frames may be angled relative to each other to form an arch and the linked frames may be pivoted together at the locations where the frames intersect to enable folding of the framework into a more compact shape.

17 Claims, 9 Drawing Sheets

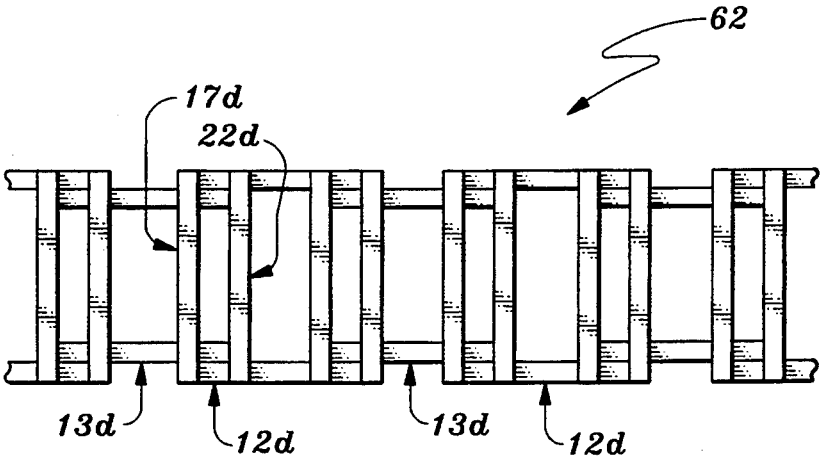
FIG. 22
FIG. 21
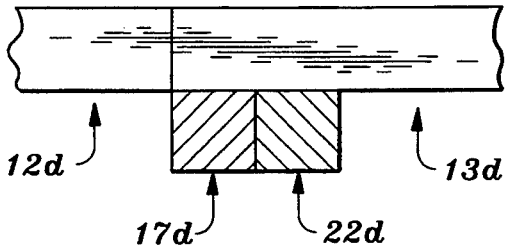
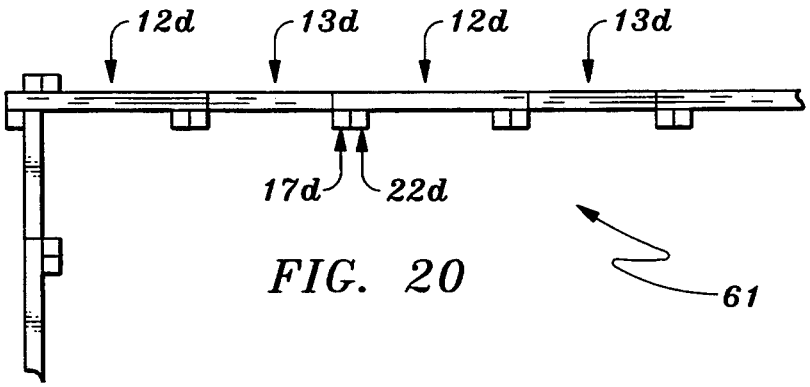
FIG. 20
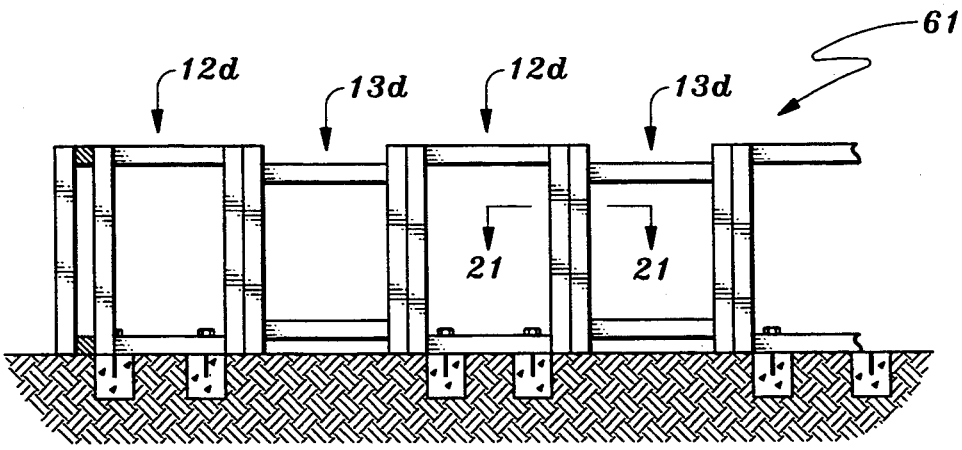
FIG. 19

LINKING FRAMES CONSTRUCTIONS

TECHNICAL FIELD

This invention relates to structural frameworks and to components for assembling frameworks and more particularly to frameworks and framework components wherein the framework is formed by joining a series of similar components together.

BACKGROUND OF THE INVENTION

Diverse different types of structure are essentially an open framework or include such a framework as a support for other structural members. For example, many buildings, garden structures, bridges, fences and playground constructions are framed structures of this type. Frameworks of this kind which are constructed in the traditional manner rely largely on nails, screws or other hardware to provide structural integrity and load bearing capability to the framework. It would be advantageous if the framework components were interlinked in a manner which inherently resists deformation of the structure apart from any fasteners or other hardware that may be present.

Component members of traditional frameworks are custom made to have lengths that will result in a framework of the desired size and configuration. It would be advantageous if frameworks of different sizes, configurations and esthetic appearances could be easily assembled from the same stock of components.

The traditional construction and use of conventional components also results in a framework that cannot be temporarily reduced in size, for storage or transportation, unless it is disassembled by removing the fasteners. It would be advantageous if such frameworks could be easily converted into a more compact from without being disassembled.

The present invention is directed to overcoming one or more of the problems discussed above.

SUMMARY OF THE INVENTION

In one aspect of the present invention, a structural framework includes at least a first and a second framework member each having transversely extending opposite ends and longitudinally directed opposite sides. At least the first frame member has an opening situated between the opposite ends and opposite sides and the second frame member has at least one sidewardly extending projection at least at one of the ends of the second frame member. The first and second frame members are in a linked relationship in which one end of the first frame member overlaps and abuts the sides of the second frame member and in which at least one of the sides of the second frame member extends into the opening of the first frame member. The sidewardly extending projection overlaps and abuts a side of the first frame member.

In another aspect, the invention provides a structural framework formed by a plurality of rectangular frames each having longitudinally extending side members and transversely extending end members. The frames are disposed in an end to end relationship and include a plurality of first frames alternated with a plurality of of second frames. The side members of the second frames are closer together than the side members of the first frames and extend between the side members of the two adjacent ones of the first frames. The transversely extending end members of the second frames have extremities which extend laterally outward from the side members thereof to overlap and abut the side members of the adjacent ones of the first frames.

In another aspect of the invention, the frames are angled relative to each other to impart an arch shape to the framework, the end members of the frames being at the outer surface of the arch.

In another aspect of the invention, a structural framework includes a plurality of rectangular frames each having first and second longitudinally extending side members and first and second transversely extending end members, the frames being disposed in end to end relationship. The frames have open centers bounded by the side members and end members. The end members protrude outward from the first side member at one side of each frame and the first side member of each of the frames extends through the open center of each of the adjacent ones of the frames in abutment with the second side members thereof. The second side member of each frame extends in parallel relationship with the first side member of the frame and abuts the first side member of the adjacent ones of the frames at locations which are outside of the open centers thereof. Alternate ones of the frames have their first side members at one side of the framework and the others of the frames have their first side members at the other side of said framework.

In a further aspect, the invention provides a framework member for use in assembling a structural framework. The member includes an open centered rectangular frame having spaced apart parallel side portions with outer side surfaces and spaced apart parallel end portions which extend between the side portions. The end portions have a length that is greater than the spacing of the side surfaces and extend outward from the side surfaces at each side of the framework member.

In another aspect of the invention, a framework member for use in assembling a structural framework includes an open centered rectangular frame having spaced apart parallel side portions with outer side surfaces and spaced apart parallel end portions which extend between the side portions. The end portions have a length that is greater than the spacing of the side surfaces and extend outward from one of the side surfaces at one side of the framework member.

In still another aspect, the invention provides a framework member which includes an open centered rectangular frame having spaced apart parallel side portions with outer side surfaces and spaced apart parallel end portions which extend between the side portions. The end portions have a length that is greater than the spacing of the side surfaces and extend outward from at least one of the side surfaces. The end portions are offset from the plane in which the side portions extend.

The invention enables easy assembling of framed structures having different sizes, configurations and/or aesthetic designs from a series of frame components which link together in an end to end relationship. The linkage is of a form which can inherently impart structural rigidity and load bearing capability to the framework. Nails, screws or the like may be used to positively attach the frame components to each other but are not necessarily required in some constructions that can be assembled from the framework components. In one form of the invention, the framework components may be pivoted together to enable temporary folding of the structure into a more compact configuration for transportation or storage.

The invention, together with further aspects and advantages thereof, may be further understood by reference to the following description of the preferred embodiments and by reference to the accompanying drawings.

BRIEF DESCRIPTION OF THE DRAWINGS

FIG. 19 is an elevation view of a fence assembled from linking frames of the type shown in FIG. 18.

FIG. 20 is a top view of the fence of FIG. 19.

FIG. 21 is a section view taken along line 21—21 of FIG. 19.

FIG. 22 is an elevation view of another and differently appearing fence which can be assembled using the same components that are used in the fence of FIGS. 19 to 21.

DETAILED DESCRIPTION OF THE PREFERRED EMBODIMENTS

Figure 1:
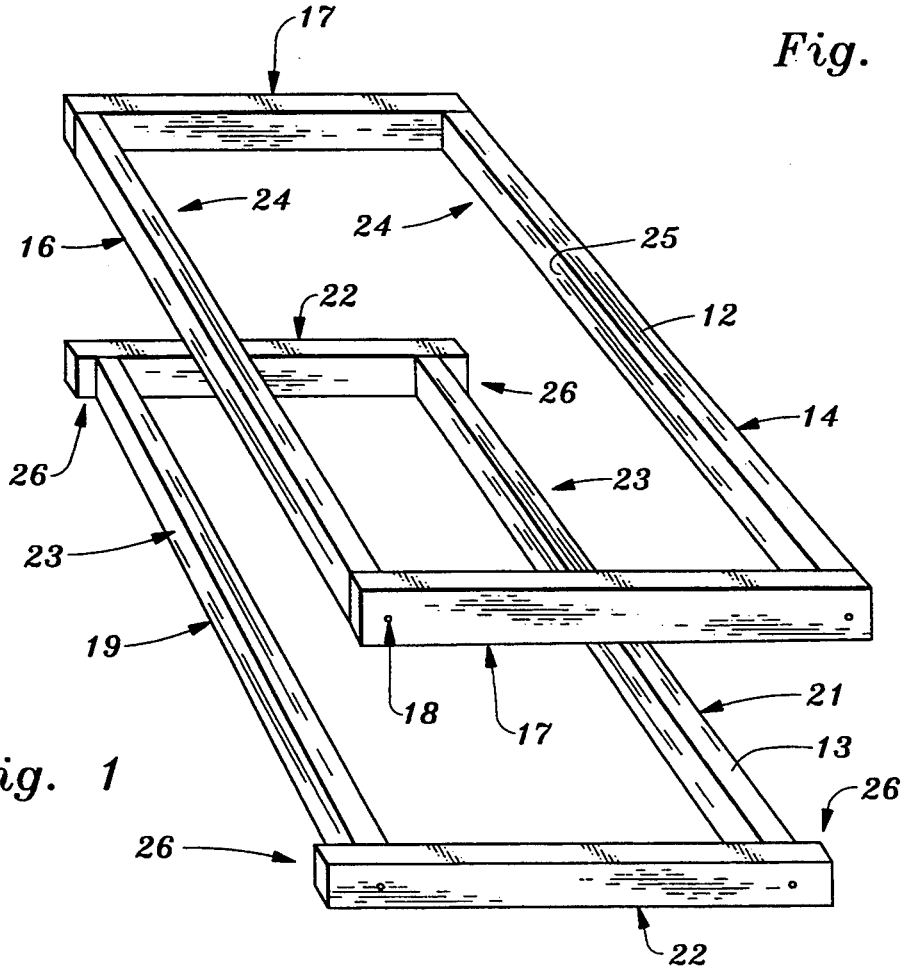
FIG. 1 a perspective view of a first pair of linking frames for use in assembling frameworks.

Referring initially to FIG. 1 of the drawings, frameworks in accordance with the invention are assembled from linking frames 12 and 13 examples of such assembled frameworks being hereinafter described. This embodiment of the invention uses first frames 12 and second frames 13 that are of different configuration and which link with each other in an end to end relationship.

The first frames 12 are open centered rectangular frames having longitudinally extending, parallel, spaced apart side members 14 and 16 respectively and transverse end members 17 which extend between the side members at the ends of the frame. The frame 12 may be formed of any of various materials such as wood, for example, in which case the members 14, 16 and 17 may be secured together by screws 18 or other known fasteners. Functionally similar frames may be formed of metal, plastic or the like and in some cases the members 14, 16 and 17 may be different portions or regions of an integral body of material.

The second frames 13 are also essentially open centered rectangular frames which have first and second spaced apart, parallel, longitudinally extending side members 19 and 21 respectively and transverse end members 22 which extend between the side members at the ends of the frame.

The side members 19 and 21 of the second frames 13 are closer together than the corresponding members 14 and 16 of the first frames 12. In particular, the outer sides 23 of the second frame side members 19 and 21 are spaced apart a distance that corresponds to the spacing of the inner sides 24 of the side members 14 and 16 of the first frame members 12. This enables insertion of an end region of the second frame 13 into the center opening 25 of the first frame 12.

The transverse end members 22 of the second frame 13 have a length that exceeds the spacing of the inner edges 24 of the side members 14 and 16 of the first frame 12 and extend outward from the side members 19 and 21 of the second frame at each side of the frame. Thus the extremities of end members 22 form sidewardly directed projections 26 at each side of each end of the second frame 13.

Frames 12 and 13 of this kind may be linked together in an alternating end to end relationship to form diverse different constructions. For example, with reference to FIGS. 2, 3 and 4 in conjunction, a series of the frames 12 and 13 may be linked to form an upstanding arch 11.

Figure 5:
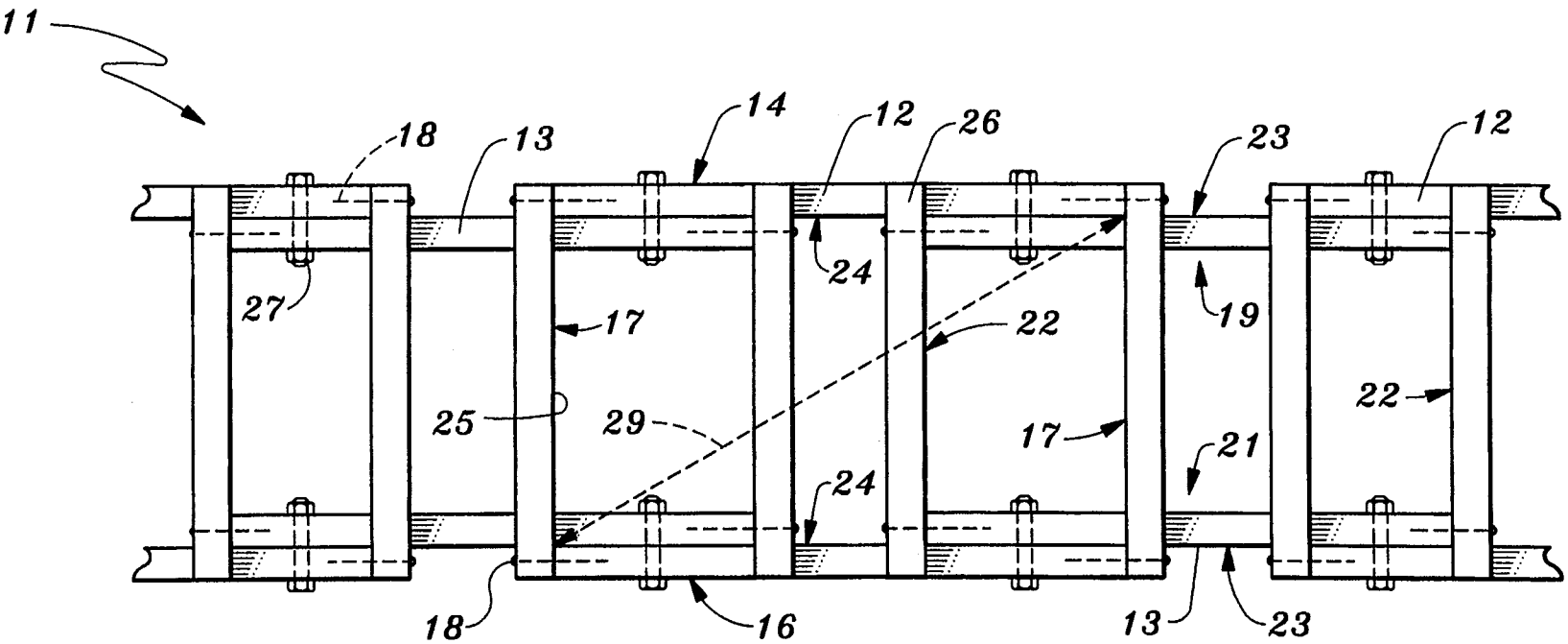
FIG. 5 is an enlarged top view of a portion of the arch of the preceding figures.

In the assembled construction 11, first frames 12 alternate with second frames 13 and each frame is in an angled relationship with the adjacent frames. The ends of the second frames 13 extend into the open centers 25 of the adjacent first frames 12. Referring to FIG. 5, the end members 17 of the first frames 12 overlap and abut the side members 19 and 21 of the adjacent second frames 13 and the projections 26 at the ends of the second frames overlap and abut the side members 14 and 16 of the adjacent first frames. The end members 17 and 22 of the frames are at the upper or convex face of the arch 11. Thus gravitational force and any downwardly directed load forces tend to hold the end members of each frame in abutment with the side members of the adjacent frames. This makes the arch 11 resistant to deformation by such downwardly directed forces. Friction arising from the downward forces resists longitudinal movement of the frame members 12 and 13 relative to each other.

This inherent resistance to deformation is most pronounced at those portions of the arch 11 which extend horizontally and decreases in magnitude towards the ends of the arch where the frames 12 and 13 become progressively more vertically oriented. Arches 11 which extend through less than a semicircle of arc may not require any further arrangements to assure structural stability. Fasteners 27 may be used to assure that there will be no longitudinal movement of the frames 12 and 13 relative to each other in instances the end ones of the frame members have a highly vertical orientation or where the usage of the arch 11 requires positive assurance against such movement.

Figure 6:
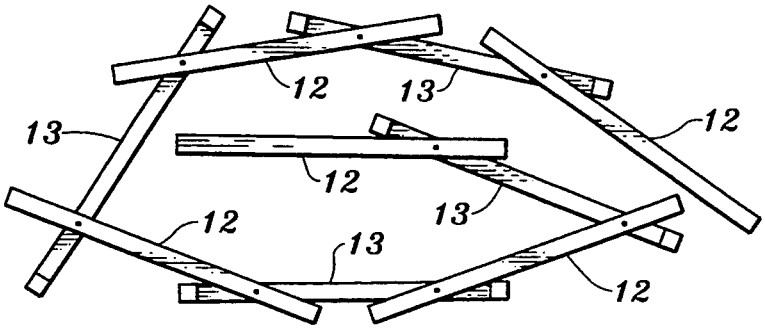
FIG. 6 is a side elevation view depicting the arch of the preceding figures folded into a more compact configuration.

The fasteners 27 in this particular example are bolts which extend through the side members 14, 16, 19 and 21 of each linked pair of frames 12 and 13 at the locations where the side members intersect each other, the pair of bolts which secure each pair of frames together being colinear. Such bolt fasteners 27 can function as pivot pins which enable inversion of the arch 11 followed by folding of the frames 12 and 13 relative to each other to make the structure more compact, as shown in FIG. 6, when it is to be transported or stored. In other instances, the fasteners 27 can be screws, nails or the like.

Figure 7:
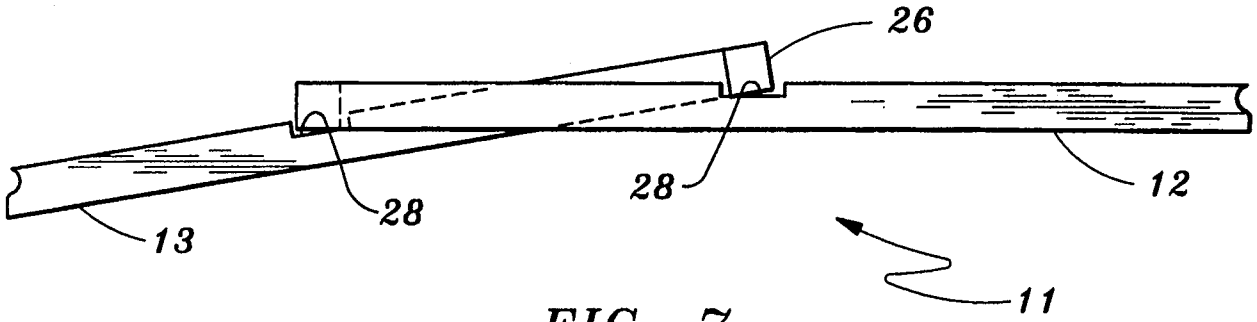
FIG. 7 is a side view of a pair of linked frame members depicting a modification of such members.

Referring to FIG. 7, structural integrity of the arch 11 can be further enhanced by providing notches 28 in the first frames 12 in which the projections 26 of the second frame members 13 are received.

Referring again to FIG. 5, the frames 12 and 13 may be prefabricated components which can be easily linked together to form constructions such as arch 11. For this purpose, the center openings 25 of the first frames 12 should have a diagonal dimension, depicted by arrow 29 in the drawing, that is at least equal to the length of the transverse end members 22 of the second frames 13. This enables linking of a prefabricated second frame 13 to a prefabricated first frame 12 by angling an end of the second frame relative to the first frame and and then inserting the angled end through the opening 25 of the first frame followed by seating of the projections of the second member against the side members 14 and 16 of the first frame. Disassembly of the arch 11 is equally easy in instances where the members 12 and 13 are not secured together by fasteners.

Figure 9:
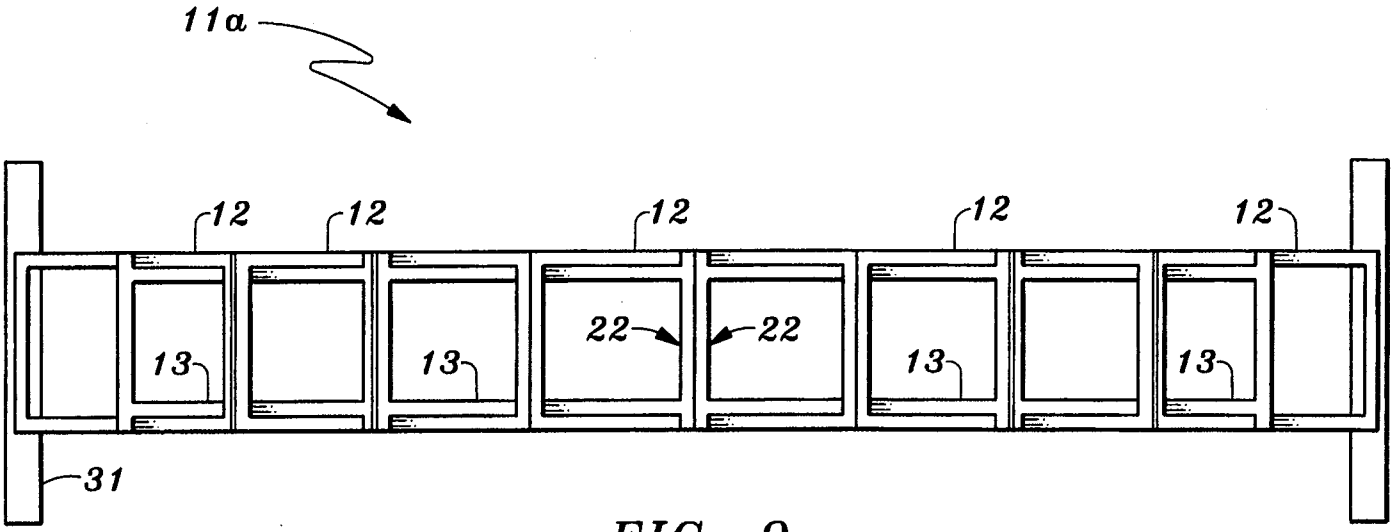
FIG. 9 is a top view of the arch of FIG. 8.
Figure 8:
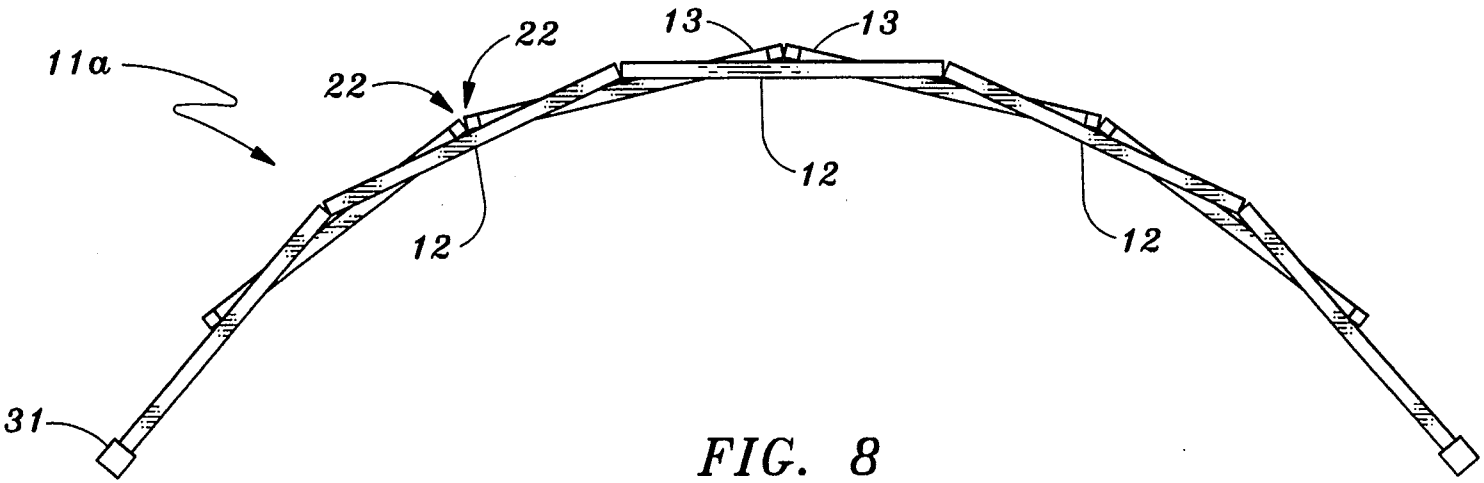
FIG. 8 is an elevation view of an arch having the same components as the arch of the preceding figures but which has a greater span and a lesser curvature.

The single stock of prefabricated frames 12 and 13 of a given size may be used to construct arches 11 having different curvatures and which span different distances. The curvature of the arch 11 is determined by the spacing of the end members 22 of the two second frames 13 that are linked to the same first frame 12. Moving the end members 22 closer together decreases the curvature of the arch 11. Moving the end members 22 further apart increases curvature and reduces the span of the arch. FIGS. 8 and 9 depict an arch 11a formed with the same components and number of components that are used in the arch of the preceding figures but which is of lesser curvature and greater horizontal length.

Different portions of the arch 11 may be caused to have different curvatures by varying the spacing of the end members 22 along the arch. An arch 11 which is highly resistant to deformation is produced if the two end members 22 that are adjacent each first frame 12 are abutted against each other as in the construction of FIGS. 8 and 9. This provides a positive blocking of longitudinal movement of the frames 12 and 13 relative to each other.

The frames 12 and 13 may be prefabricated with a range of different sizes to enable assembly of structures of greatly varying size. A group of very small frames 12 and 13 makes an entertaining children's toy as diverse small constructions can easily be assembled and disassembled.

Referring again to FIGS. 2, 3 and 4, lateral stability of the arch 11 can be enhanced, if necessary, by securing transverse foot members 31 to the ends of the arch which members have a greater length than the width of the frames 12 and 13.

Figure 10:
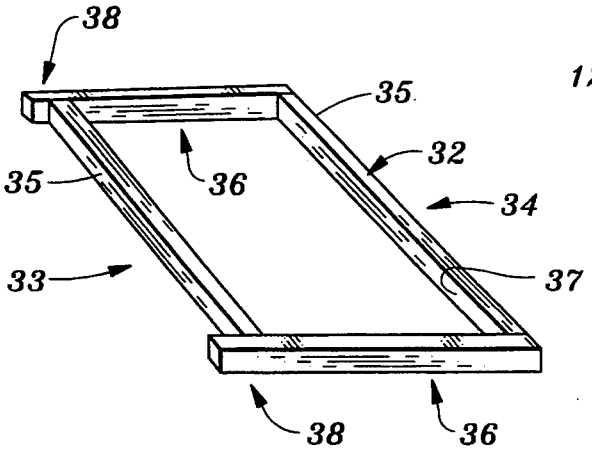
FIG. 10 is a perspective view of another embodiment of linking frame for use in assembling frameworks.

The above described embodiment of the invention enables prefabrication of a stock of the two types of frames 12 and 13 and later assembly of arches 11 of different sizes and curvatures from the same stock of frame members. Referring to FIG. 10, an alternate form of frame 32 enables linking of frames that have the same configuration. Use of two different types of frames is unnecessary although the alternate construction requires that the frames 32 be linked together prior to complete assembly of the frames.

Frames 32 are open centered rectangular frames having parallel, longitudinally extending first and second side members 33 and 34 respectively and parallel, transverse end members 36 which extend between the ends of the side members and which bound the central opening 37 of the frame. End members 36 have a length which exceeds the spacing of the outer edges 35 of side members 33 and 34 and have extremities which form projections 38 that extend outward from the outer edge 35 of the first side member 33. The end members 36 need not project outward from the other side member 34 of the frame 32 but such additional projections may be provided in some constructions for decorative reasons, to facilitate the attachment of adjacent frameworks to each other or for other purposes.

Figure 12:
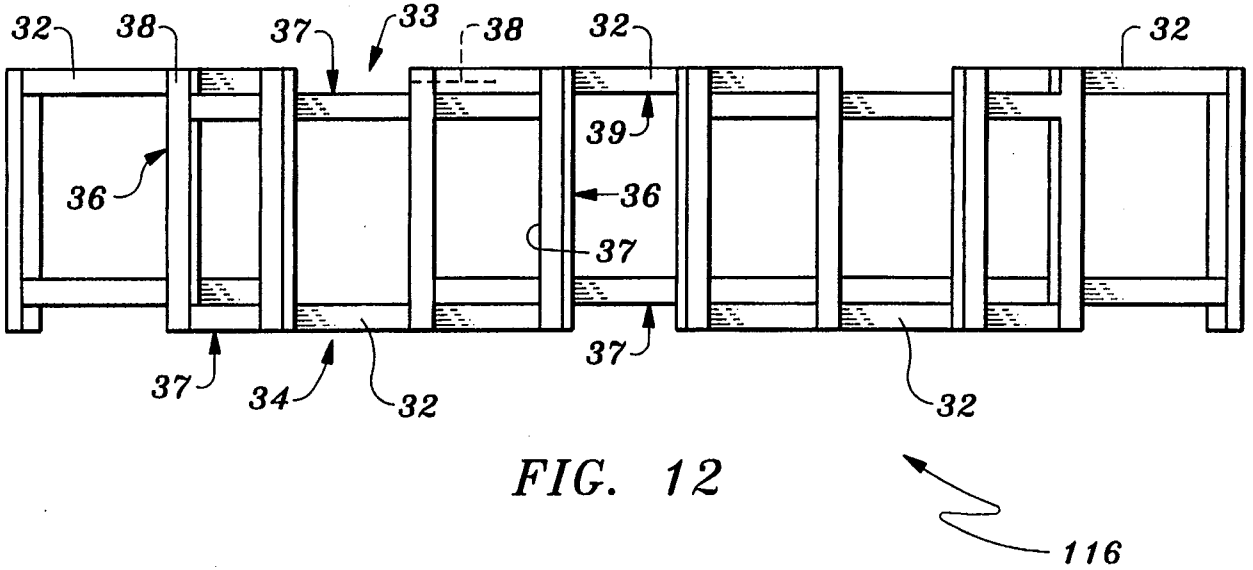
FIG. 12 is a top view of the arch of FIG. 11.
Figure 11:
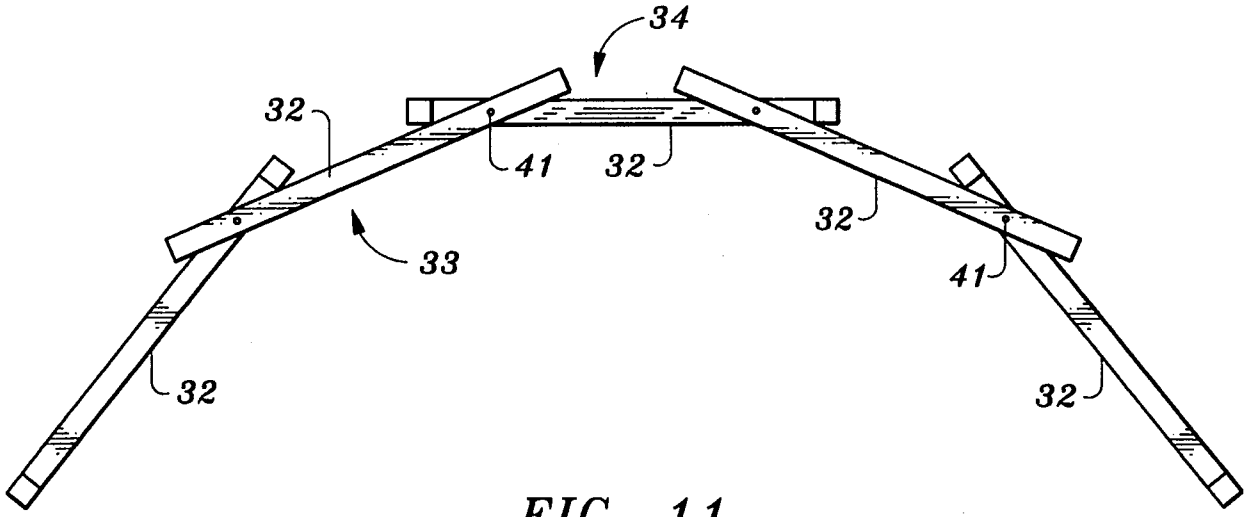
FIG. 11 is an elevation view of another arch which is constructed of linked frame members of the type shown in FIG. 10.

Referring jointly to FIGS. 11 and 12, identical frames 32 of this type are linked with each other to form constructions, such as another arch **11*b*, by reversing the orientation of each frame in the series relative to the orientation of the frame to which it is linked. In particular, the first side members 33 and thus the projections 38 of successive ones of the linked frames 32 are at opposite sides of the arch 11*b*. During assembly of each frame 32 and prior to the emplacement of screws 38, nails or other fasteners at one corner of the frame, the first side member 33 is inserted through the center opening 37 of the adjacent frame to which it is to be linked. The screws 38 or the like are then put in place to complete the frame. In the assembled arch 11*b*, the first side member 33 of each frame 32 abuts the inside edges 39 of the second side members 34 of the adjacent frames to which it is linked. The second side member 34 of the frame abuts the outer edges 37 of the first side members 33 of the adjacent frames. The projections 38 of each frame 32 overlap and abut the second side members 34 of the adjacent frames thereby resisting deformation of the arch 11*b*** by downwardly directed forces.

Friction at the abutments of the projections 38 with the adjacent frames 32 resists sideward displacement of one frame relative to the frames to which it is linked. In instances where positive assurance against such displacement is needed this may be provided by bolts 41 at the intersections of the side members 33 and 34 of the successive frames 32 or by nailing, screwing or otherwise fastening the frames together.

While the frames 32 are linked together at the time of assembly of the frames, the arch **11*b* need not be placed in it final configuration at that time. Arches 11*b* having different curvatures and different spans may be erected from the same chain of loosely linked frames 32 by adjusting the spacing of adjacent frame end portions 36 along the arch prior to emplacement of the bolts 41** or other fasteners.

Figure 3:
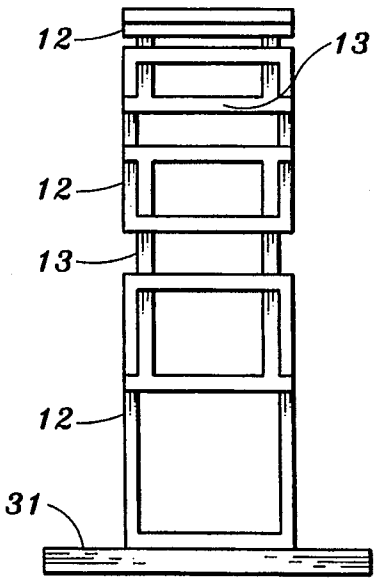
FIG. 3 is a side view of the arch of FIG. 2.
Figure 4:
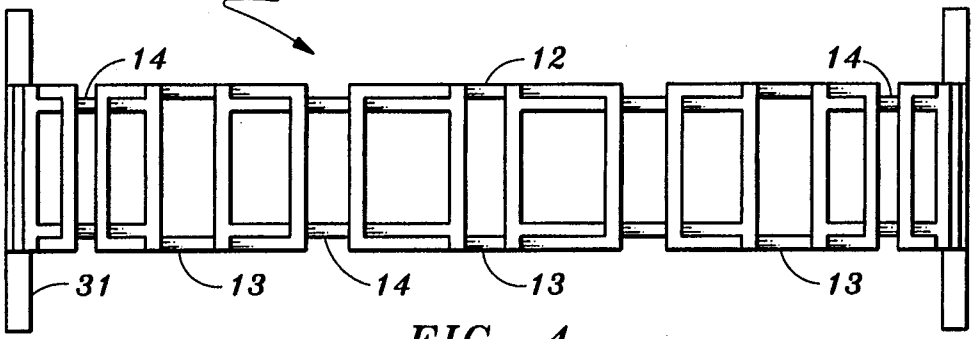
FIG. 4 is a top view of the arch of the preceding figures.
Figure 2:
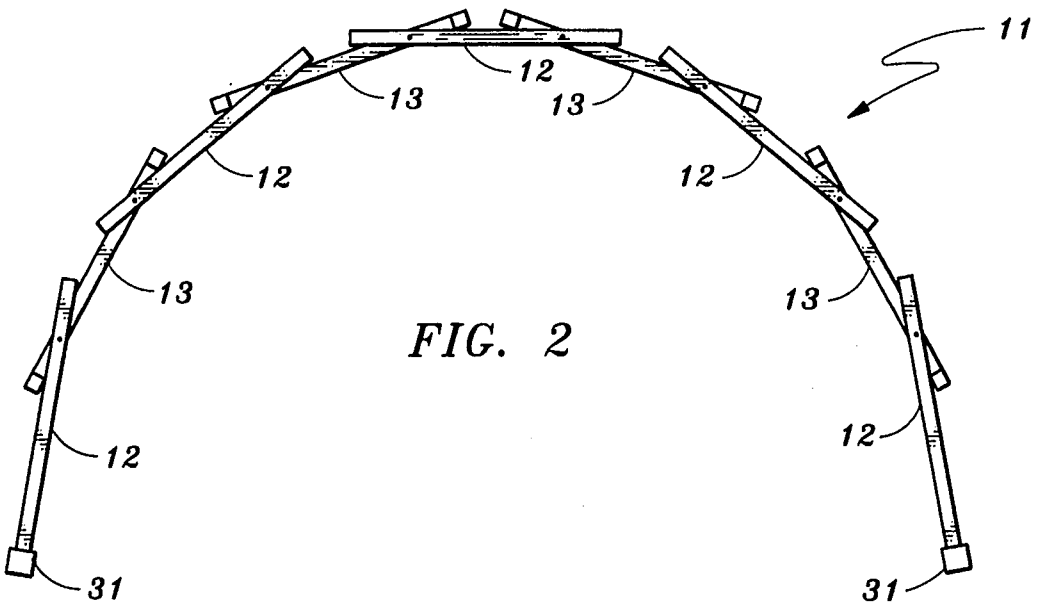
FIG. 2 is an elevation view of an arch formed of linked frame members of the type depicted in FIG. 1.

The second frames 13 of the embodiment of FIGS. 2, 3 and 4 need not necessarily have an open center and in the alternate embodiment of FIGS. 11 and 12 the center openings 37 of the frames 32 may be reduced to longitudinally extending slots just wide enough to receive the first side portions 33 of the adjacent frames 32.

Figure 14:
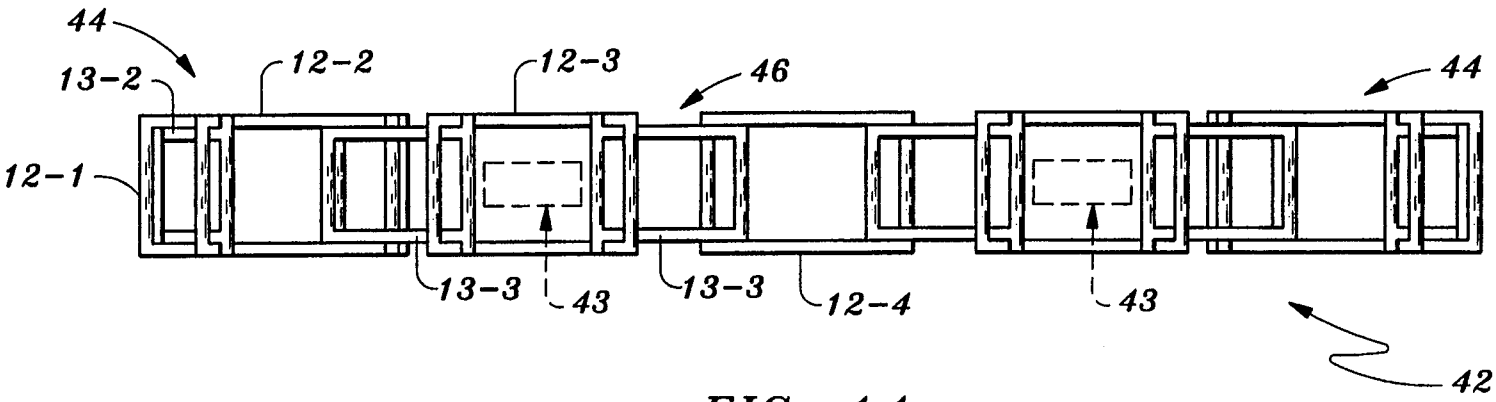
FIG. 14 is a top view of the playground structure of FIG. 11.
Figure 13:
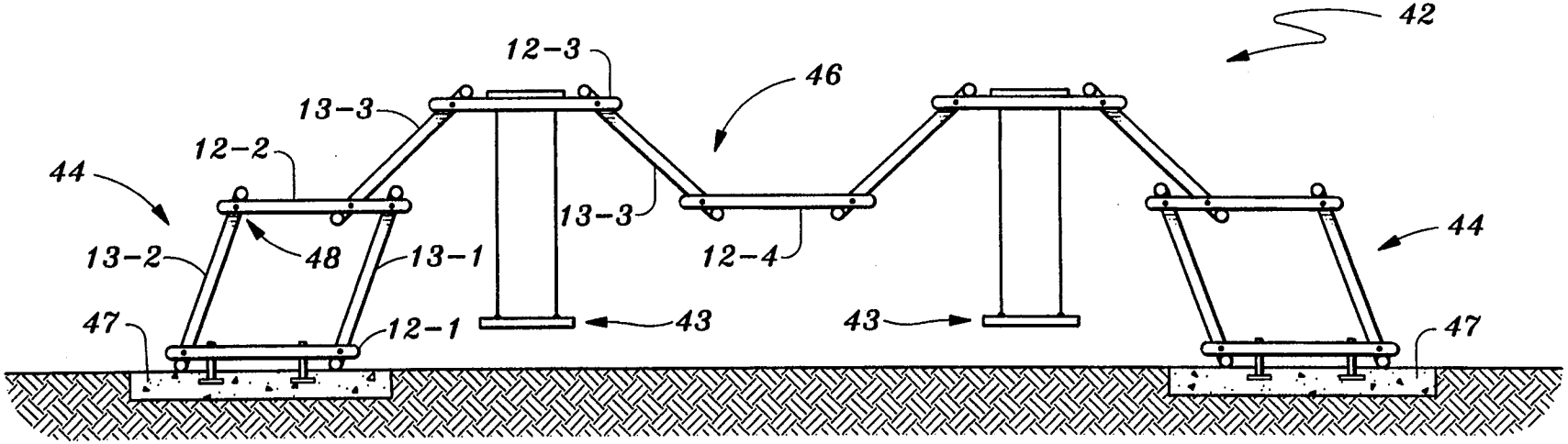
FIG. 13 is an elevation view of a playground structure embodying the invention.

The invention has been described above with reference to the construction of simple arches. The linking frames may also be used to form structures having a more complex configuration. FIGS. 13 and 14 illustrate an example which is a playground structure 42 for supporting a pair of child's swing sets 43.

The structure 42 of FIGS. 13 and 14 uses first and second frames 12 and 13 of the kind previously described with reference to FIG. 1. Referring to FIGS. 13 and 14, the structure 42 has spaced apart opposite end regions 44 each of which is formed by a lower first frame 12-1 and a parallel upper first frame 12-2 linked at their corners by a pair of upwardly inclined second frames 13-1 and 13-2. The parallelogram frameworks formed by such frames are aligned with each other and incline towards each other. The end regions 44 are spanned by an elevated double arch 46, one of the swing sets 43 being suspended from the top of each arch. Each of the arches is formed by a horizontal first frame 12-3 which is linked at its corners with a pair of the second frames 13-3 each of which inclines downward and outward from the ends of the first frame 12-3. The lower ends of the second frames 13-3 which are at the ends of the double arch 46 are linked in the previously described manner with the upper first frames 12-2 of end regions 44 of structure 42 and also bear against the upper ends of the innermost second frames 13-1 of end regions 44. The lower ends of the other two second frames 13-3 are linked in the previously described manner by another horizontal first frame 12-4.

When the lower frames 12-1 of the end regions 44 are secured to the supporting surface, such as by being bolted to concrete pads 47, the playground structure 42 becomes inherently resistant to deformation by external forces independently of any fasteners that may be used to positively secure the frames 12 and 13 to each other. Pivot bolts 48 at the intersections of the linked frames 12 and 13 may be provided for added assurance and to eliminate looseness in the structure but the structure remains intact in the event of failure of one or more bolts.

Figure 15:
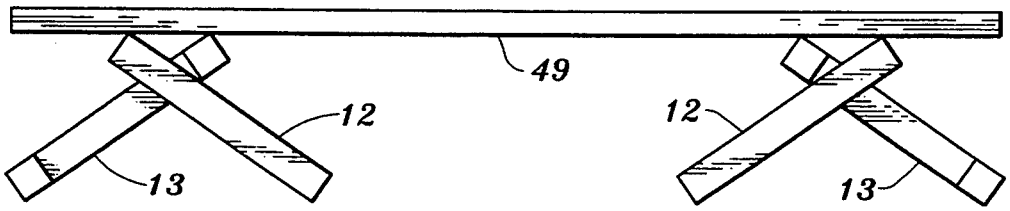
FIG. 15 is an elevation view illustrating use of a pair of the linked frame members as a support for other structure.

The linking frames 12 and 13 can be quickly assembled to form any of a great variety of useful constructions. FIG. 15, for example, depicts usage of first and second pairs of linked frames 12 and 13 which are spanned by a plank 49 to form a temporary bench.

Figure 16:
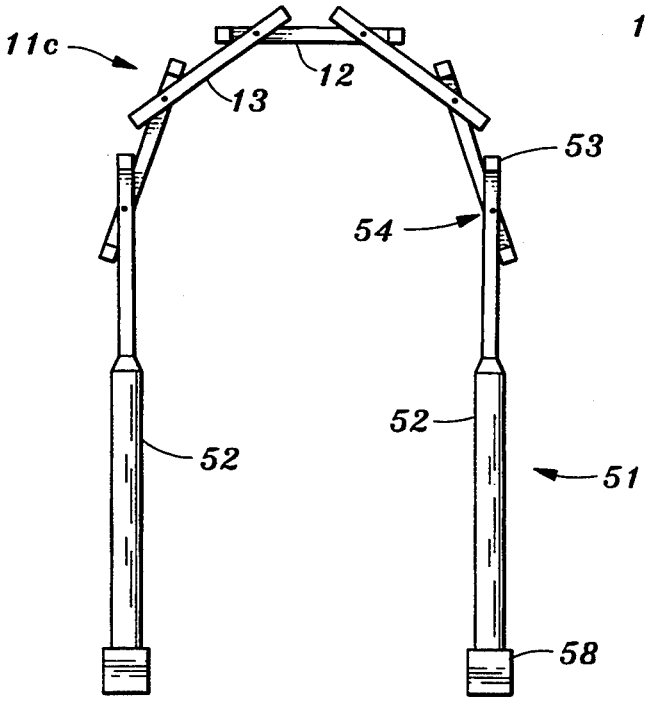
FIG. 16 is an elevation view of a garden trellis which utilizes the linked frame members in conjunction with other structural components.
Figure 17:
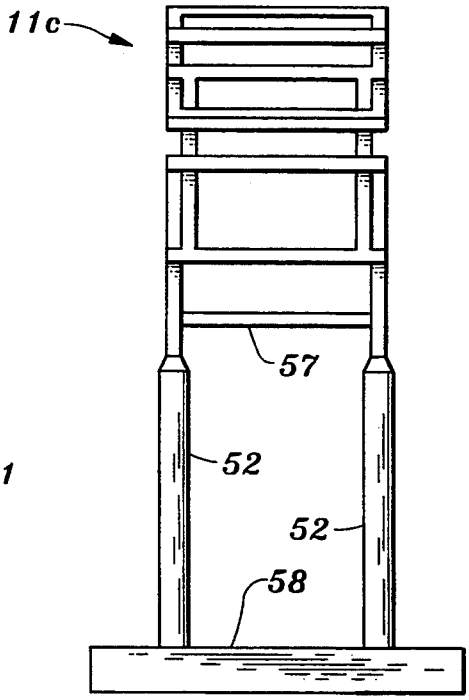
FIG. 17 is a side view of the trellis of FIG. 16.

It is also possible to combine the linking frames 12 and 13 with other structural components. FIGS. 16 and 17, for example, depict a garden trellis 51 having an upper region **11*c* which is an arch formed of linked first and second frames 12 and 13 of the previously described kind and which describes a 180° degree arc in this case. Each end of the arched upper region 11*c* is supported at an elevated location by a pair of spaced apart vertical posts 52 which are spanned at the top by a cross member 53. The upper ends of the posts have a spacing corresponding to the distance between the outer edges 23 of the second frames 13 at the ends of the arch 11*c* and the second frame extends between the posts. Bolts 54 extend through the intersections of the posts 52 and the end frames 13. The end member 22 of each end frame 13 of the arch abuts the posts 52 and thus the construction prevents pivoting motion at bolts 54 of the kind that might otherwise allow collapse of the structure when it is in a freestanding condition. The lateral projections 26 at the ends of the end frames 13 of the arch abut the posts 52 and thus have the same effect. Friction, brought about by the weight of the structure, inhibits pivoting movement of the posts 52 in the direction of each other when the structure is in the freestanding condition. Additional cross members 57 extend between the posts 52 at each side of the trellis 51 at a location below cross members 53 to make the posts and cross members a rigid framework. Cross members 58, which have a length greater than the spacing of the posts 52**, may be provided at the base of the posts to provide greater stability in instances where the bases of the posts will not be embedded in the ground or in concrete.

Figure 18:
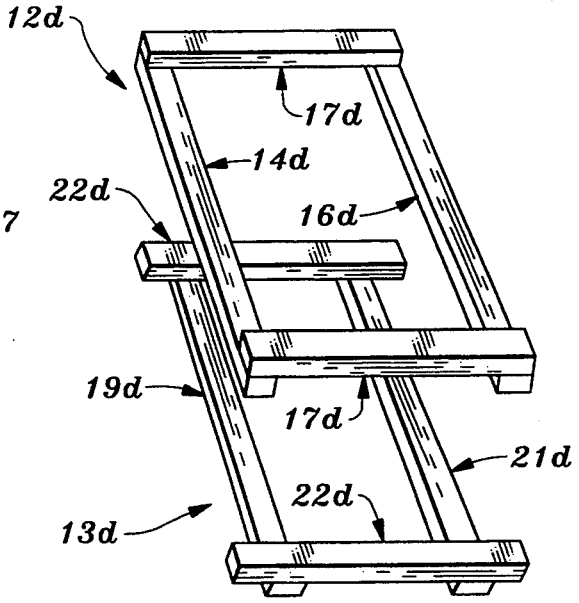
FIG. 18 is a perspective view of still another embodiment of the linking frames for use in assembling frameworks.

The previously described embodiments of the invention use frames which link together in an at least somewhat angled relationship with each other and thus form arching or angled frameworks. Linking frames of any of the hereinbefore described types may be modified to enable assembly of planar or rectilinear frameworks by repositioning the end members of the frames. Referring to FIG. 18, first and second linking frames **12*d* and 13*d* for this purpose may, for example, be similar to those previously described with reference to FIG. 1 except insofar as the transversely extending end members 17d of the first frames 12*d* are offset from the plane of the longitudinally extending side members 14*d* and 16*d*. The end members 22*d* of the second frames 13*d* are similarly offset from the plane of the side members 19*d* and 21*d* of those frames. Thus the end members 17*d* and 22*d* of both types of frame abut sides of the side members 14*d* and 16*d* or 19*d* and 21*d*** rather than ends of the side members.

The frames **12*d* and 13*d* are linked together in the same manner as in the previously described embodiments of the invention except that the offset end members 17*d* and 22*d* enable the frames to be aligned in a coplanar relationship while in the linked condition. Referring jointly to FIGS. 19, 20 and 21, this enables use of such frames 12*d* and 13*d* to form flat constructions such as a fence 61** in this example.

The same set of linking frames **12*d* and 13*d* can be used to assemble structures of different configuration and appearance. In the fence of FIGS. 19, 20 and 21, the end members 17*d* of first frames 12*d* are abutted against the end members 22*d* of the second frames 13*d*. Referring to FIG. 22, a fence 62 of different configuration and distinctly different appearance can be produced from the same frames 12*d* and 13*d* by spacing the end members 17*d* and 22*d*** apart from each other.

Figure 24:
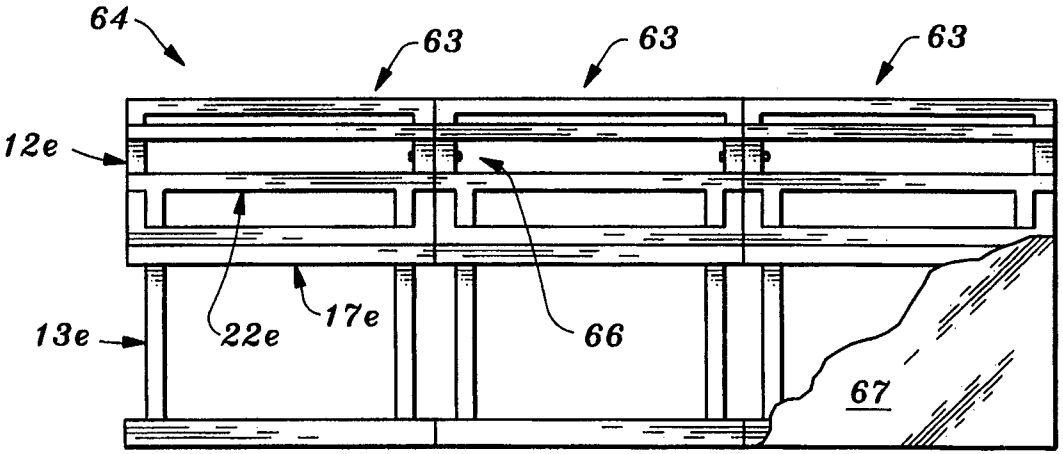
FIG. 24 is a broken out side elevation view of the building of FIG. 23.
Figure 23:
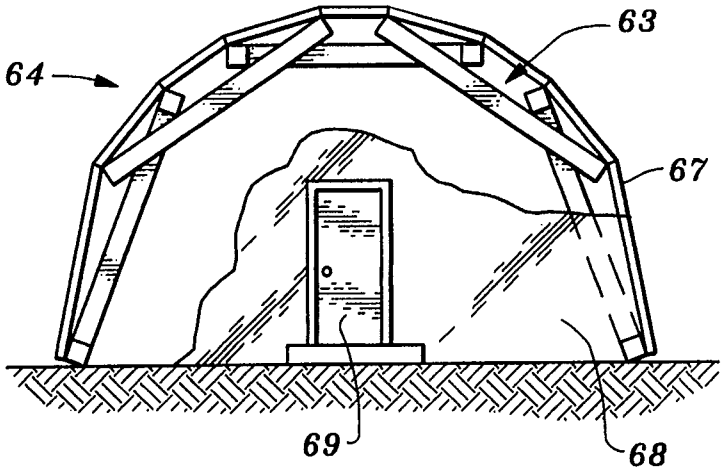
FIG. 23 is a broken out front elevation view of a building framed by linking frames of the type shown in FIG. 1.

Groups of linked frameworks of the hereinbefore dedescribed kinds can be fastened together to form still more complex structures. Referring to FIGS. 23 and 24, for example, a plurality of arches 63 of the hereinbefore described type can be disposed together in side by side relationship to form the framing of a building 64. The proportions of the building 64 may be adjusted to suit the intended usage of the building by adjusting the spacing of the end members **17*e* and 22*e* of the linking frames 12*e* and 13*e*. The arches 63 may be secured together by bolts 66 or other fasteners which are preferably located at abutting first frame members 12*e* of the arches 63. Sheathing 67 and end walls 68 with access doors 69 may be fastened to the framework formed by arches 63. The arches 63 in this example define the roof and opposite side walls of building 64**. An essentially similar group of arches may also be used to frame only the roof of a building which is otherwise of conventional construction.

While the invention has been described with reference to certain specific embodiments for purposes of example, many variations are possible and it is not intended to limit the invention except as defined by the following claims.

I claim:

1. A structural framework comprising at least a first and a second frame member each having longitudinally directed opposite sides and transversely extending opposite ends which extend between the opposite sides, at least said first frame member having an opening situated between said opposite ends and between said opposite sides, said second frame member having at least one sidewardly extending projection at least at one of said ends thereof, said first and second frame members being in a linked relationship wherein one end of said first frame member overlaps and abuts said sides of said second frame member and wherein at least one of said sides of said second frame member extends into said opening of said first frame member and said sidewardly extending projection overlaps and abuts a side of said first frame member.

2. The structural framework of claim 1 including a plurality of said first frame members and a plurality of said second frame members disposed in alternating relationship and wherein at least one of said sides of a second frame member extends through said openings of two adjacent said first frame members and wherein said second frame member has a sidewardly extending projection at each of said opposite ends thereof which projections overlap and abut the sides of the adjacent said first frame members.

3. The structural framework of claim 2 wherein successive ones of said first and second frame members are angled relative to each other to form an upstanding arch, said projection of each of said second frame members being at the convex side of said arch.

4. The structural framework of claim 1 wherein said first frame member and said second frame member are secured to each other at the location where said side of said second frame member extends into said opening of said first frame member.

5. The structural framework of claim 4 wherein said first and second frame members are secured to each other at said location by means for enabling pivoting of said first and second frame members relative to each other.

6. The structural framework of claim 1 wherein said sidewardly extending projection of said second frame member is situated at a first end thereof and wherein said second frame member has a second sidewardly extending projection situated at the opposite end thereof.

7. The structural framework of claim 1 wherein said opposite sides of said first and second frame members extend within a first plane and wherein transversely extending opposite ends of said first and second frame members are offset from said first plane.

8. The structural framework of claim 1 wherein said second frame member has a first pair of said sidewardly extending projections situated at a first end of said second frame member and has a second pair of said sidewardly extending projections situated at the opposite end of said second frame member, the projections of each pair being colinear and being at opposite sides of said second frame member.

9. The structural framework of claim 1 wherein each of said first and second frame members is a rectangular frame having spaced apart longitudinally extending side members forming said opposite sides thereof and transversely extending end members which extend between said side members and which form said opposite ends thereof, said longitudinally directed opposite sides and transversely extending opposite ends of said frame members forming an open center in each frame member, the open center of said first frame member being said opening thereof, said sides of said second frame member being spaced apart a distance which corresponds to the width of said opening of said first frame member and wherein both of said opposite sides of said second frame member extend through said opening of said first frame member.

10. The structural framework of claim 9 wherein said transversely extending ends of said second frame member have a length which is greater than the distance by which said sides of said second frame are spaced apart, the extremities of said transversely extending end members of said second frame member being said sidewardly extending projections thereof.

11. The structural framework of claim 1 wherein said second frame member has a pair of said sidewardly extending projections situated at opposite end regions of said second frame member and at the same side thereof.

12. The structural framework of claim 11 wherein said first and second frame members are rectangular frames with open centers and wherein one of said sides of said second frame member extends into said open center of said first frame member and the other of said sides of said second frame member abuts said first frame member at a location which is outside of said opening.

13. The structural framework of claim 12 wherein said first and second frame members have the same configuration, said first frame member being oriented to with said projections thereof at a first side of said framework and said second frame member being oriented with said projections thereof at the opposite side of said framework.

14. In a structural framework, the combination comprising a plurality of rectangular frames each having longitudinally extending side members and transversely extending end members which extend between the side members at each end of the frame, said frames being disposed in a linked relationship, wherein said frames include a plurality of first frames alternated with a plurality of second frames and wherein said side members of said second frames are closer together than said side members of said first frames and extend between said side members of two adjacent said first frames and wherein said transversely extending end members of said second frames have extremities which extend laterally outward from said side members thereof to overlap and abut the side members of the adjacent said first frames.

15. The structural framework of claim 14 wherein said frames are angled relative to each other to impart an arch shape to said framework, said end members of said frames being at the outer surface of the arch.

16. In a structural framework, the combination comprising a plurality of rectangular frames each having first and second longitudinally extending side members and first and second transversely extending end members which extend between the side members at each end of the frame, said frames being disposed in a linked relationship, said frames having open centers bounded by said side members and end members and wherein said end members protrude outward from said first side member at one side of each frame, wherein said first side member of each of said frames extends through said open center of each of the adjacent ones of said frames in abutment with said second side members thereof and wherein said second side member of each of said frames extends in parallel relationship with said first side member thereof and abuts said first side member of the adjacent ones of said frames at locations which are outside of said open centers thereof, alternate ones of said frames having said first side members thereof at one side of said framework and the others of said frames having said first side members thereof at the other side of said framework.

17. The structural framework of claim 16 wherein said frames are angled relative to each other to impart an arch shape to said framework, said end members of said frames being at the outer surface of the arch.

* * * * *